United States Patent [19]

Underwood et al.

[11] 4,367,692

[45] Jan. 11, 1983

[54] JOINT COMPOUND DISPENSER

[75] Inventors: Arthur A. Underwood, Libertyville, Ill.; Richard L. Radtke, Cincinnati, Ohio

[73] Assignee: United States Gypsum Company, Chicago, Ill.

[21] Appl. No.: 201,677

[22] Filed: Oct. 29, 1980

[51] Int. Cl.[3] ..... B05C 3/12; B05C 3/18

[52] U.S. Cl. ..... 118/415; 118/419

[58] Field of Search ..... 118/413, 415, 43, 419, 118/405

[56] References Cited

U.S. PATENT DOCUMENTS

| | | | |
|---|---|---|---|
| 1,898,383 | 2/1933 | Nash | 118/415 X |
| 2,022,733 | 12/1935 | Parks | 118/415 |
| 2,679,232 | 5/1954 | Brown | 118/415 X |
| 3,122,781 | 3/1964 | Mutter | 118/413 |
| 3,292,575 | 12/1966 | Letterly | 118/415 X |
| 3,496,909 | 2/1970 | Bennett, Jr. | 118/415 X |
| 4,159,695 | 7/1979 | Newman | 118/415 X |

*Primary Examiner*—John P. McIntosh

*Attorney, Agent, or Firm*—Robert M. Didrick; Samuel Kurlandsky; Robert H. Robinson

[57] ABSTRACT

Wallboard joint tape is coated with joint compound as the tape is drawn through a container of the compound and made to pass through a tabbed slot in or associated with the container. The tabs urge the coated tape away from the edge of the slot which would otherwise wipe off the coating when the tape is drawn through the slot from a position higher than the slot.

4 Claims, 11 Drawing Figures

JOINT COMPOUND DISPENSER

This invention relates generally to devices for dispensing wallboard joint compound and applying it to tape adapted to cover the joint between adjacent wallboards. The invention relates more specifically to such an apparatus which, in its most economic form, may be made by modifying a container in which such joint compound is packed and sold.

Paper tape has been used for many years to cover the seams of abutting wallboards. A standard method for taping the seams used by home-handymen is to press the joint compound into the joint, spread it over the adjacent ends of the boards and then place the dry tape over the cemented seam. To finish the job, an additional coat of compound is applied over the tape and, after drying, sanded to obtain a smooth surface.

The problem of forcing sufficient compound into the joints while spreading a thin but evenly distributed coat of compound on the surfaces of the abutting wallboards has caused much grief for such handymen who spend an inordinate amount of time on the job. A number of devices for applying the joint compound on the wallboard side of the tape prior to its placement over the seam have been offered to the public as solutions to the problem.

One of such devices is sold under the trademark Tape-On-Taper by Tape-Co of Acampo, Calif. and consists of a tape roll holder and a slotted trough to hold joint compound. As the tape is fed from the roll through an entrance slot and an exit slot, joint compound adheres to the tape but, as the operating instructions warn, the tape must be drawn out of the exit slot in a straight line to avoid scraping the compound off the tape. In most instances, however, it is convenient to place a joint compound dispenser on the floor or at some other level below the workman's waist so that the desired length of tape, usually about 8 feet, may be drawn through the dispenser while standing next to the dispenser. To do so, the tape must be pulled upwardly from the dispenser. The workman is instructed by Tape-Co to avoid doing so.

A device similar to the Tape-Co dispenser is described in U.S. Pat. No. 3,496,909. It has a vertically adjustable gate overlying the exit slot but no provision is made to allow the tape to be pulled upwardly at an angle from the exit slot.

Two other U.S. patents, U.S. Pat. Nos. 2,957,449 and 3,707,427 describe more complex devices for dispensing and applying joint compound on the tape but neither suggests a device from which the tape may be drawn upwardly without scraping substantially all of the compound off of the tape as it rubs against the upper margin of the exit slot.

It is a principal object of this invention, therefore, to provide a device for applying joint compound on joint tape which may be placed so that the tape may be conveniently drawn out of the device to the desired length without having to move away from the device to a point from which one must return to cut the tape.

It is another object to provide a simple, easily constructed device for applying joint compound on joint tape.

It is another object to provide a slotted and tabbed container for joint compound from which the compound may be dispensed onto a tape as it is passed through the inverted container.

It is a further object to provide a slotted and tabbed lid for a joint compound container which may be used as a dispenser of the compound.

It is a still further object of the invention to provide a slotted joint compound container having removable tab means attached thereto.

The achievement of these and other objects of the invention will be apparent from the following description of the apparatus with reference to the accompanying drawings. Except where indicated otherwise, the apparatus is described as it rests in the upright position although the dispensing mode of some embodiments of the apparatus is achieved by inverting the apparatus whereby a top wall of a container or a lid therefor becomes the bottom wall of the apparatus.

IN THE DRAWINGS

Figure 1:
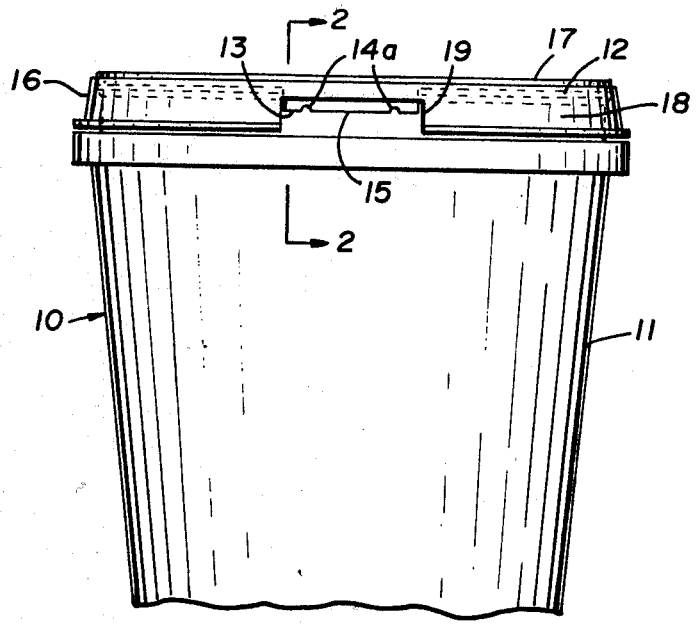
FIG. 1 is a front elevational view of one embodiment of an apparatus for applying joint compound on wallboard seam tape.
Figure 2:
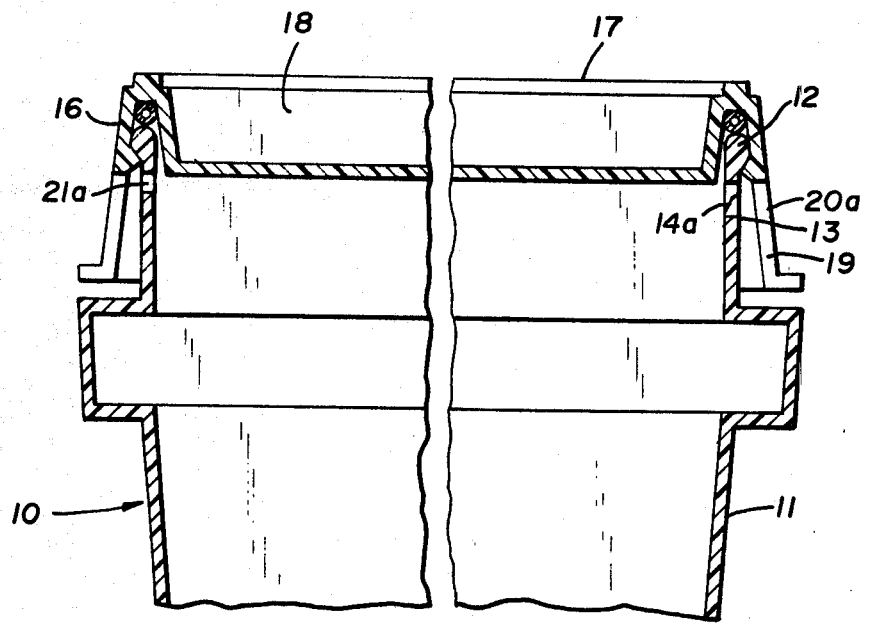
FIG. 2 is an enlarged sectional view of the apparatus of FIG. 1 along line 2—2 of FIG. 1.

Referring to FIG. 1 a pail 10 having a bottom wall (not shown), sidewall 11, and upper edge 12 is of a type used in the commercial marketing of joint compound. In the apparatus of the invention, however, edge 12 has elongate notches 13 cut out of it in the front and back sides of the pail. Tab means **14*a* consists of two tabs protruding from the horizontal margin of at least one notch 13. Said tabs are located between the vertical margins of notch 13 and on either side of mid-point 15. Lid 16 is adapted to mate with pail 10 to form a closed container for joint compound. Lid 16 has a top wall 17 and a skirt 18 in which diametrically opposed notches 19 are cut to be superimposable over notches 13 to form a tape entrance slot 20*a* and a tape exit slot 21*a* as shown in FIG. 2**.

Figure 3:
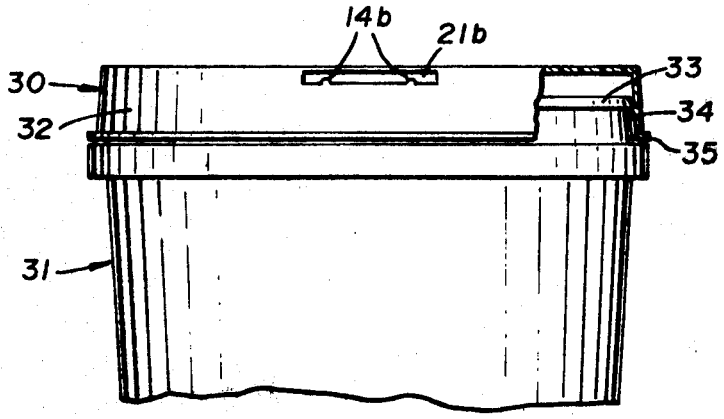
FIG. 3 is a front elevational view of another embodiment of the invention. A portion is broken away to reveal the structure further.

In FIG. 3 another ebodiment of the invention is shown wherein lid 30 functions as a dispenser of joint compound from pail 31 which is not notched. Tape entrance slot **20*b* (hidden) and tape exit slot 21*b* are elongate openings formed wholly within skirt 32 to overlie ridge 33 on the inner face of skirt 32. Ridge 33 rests upon the upper edge 34 of pail 31. Tabs 14*b* are like those shown in FIG. 1, protruding from the lower horizontal margin of one or both of slots 20*b* and 21*b* and approaching the upper horizontal margin thereof but leaving a sufficient gap to permit passage of seam tape through said slots. In lieu of ridge 33, shoulder 35 may be spaced apart sufficiently from the lower margin of slots 20***b* and 21*b* to cause said margin to lie in a plane above the upper edge 34 of the pail.

Figure 4:
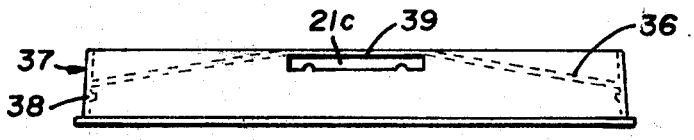
FIG. 4 is a front elevational view of another embodiment of the invention.

In FIG. 4, the top wall 36 of lid 37, is tapered from the plane of ridge 38 to a plane immediately above the margin 39 of exit slot 21*c*.

Figure 5:
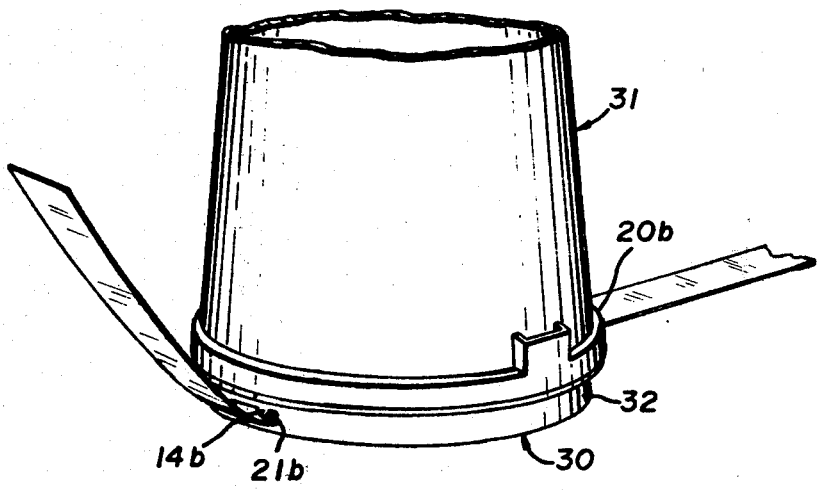
FIG. 5 is a perspective view of the apparatus of FIG. 3 shown in the dispensing mode as joint compound is applied to tape.

In FIG. 5, joint tape is shown as it is being pulled through the inverted container from a tape roll (not shown). Here the lid 30 rests under the pail 31 and serves as the base of the apparatus when it is in its dispensing mode. Scraping of the upper surface of the tape and, thus, any joint compound thereon against the margin of slot 21*b* is obviated by the presence of tabs 14*b*.

Figure 6:
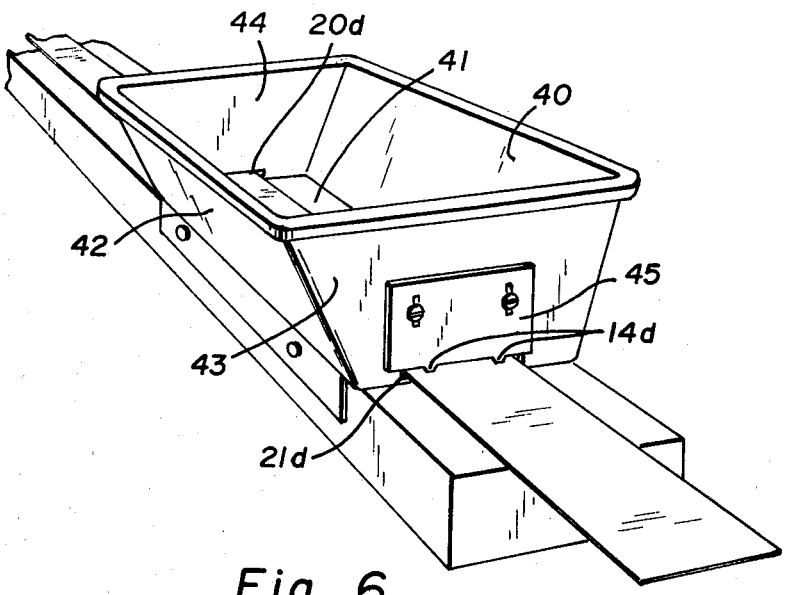
FIG. 6 is a perspective view of another embodiment of the invention.

FIG. 6 shows another embodiment of the invention in the form of an open trough 40 bounded by a bottom wall 41, a pair of side walls 42, and a pair of end walls 43 and 44. An elongated opening at the bottom of each of the end walls 43 and 44 forms a tape entrance slot 20*d* and a tape exit slot 21*d*. Flange 45 is attached to end wall 43 by any suitable means. It may be fixed in a stationary position or, as shown, it may be adapted to serve as an adjustable gate. Tabs 14*d* along the lower edge of flange 45 function as do their counterparts in FIGS. 1 through 5 as bearing surfaces which jut below the upper margin of slot 21*d*.

Figure 7:
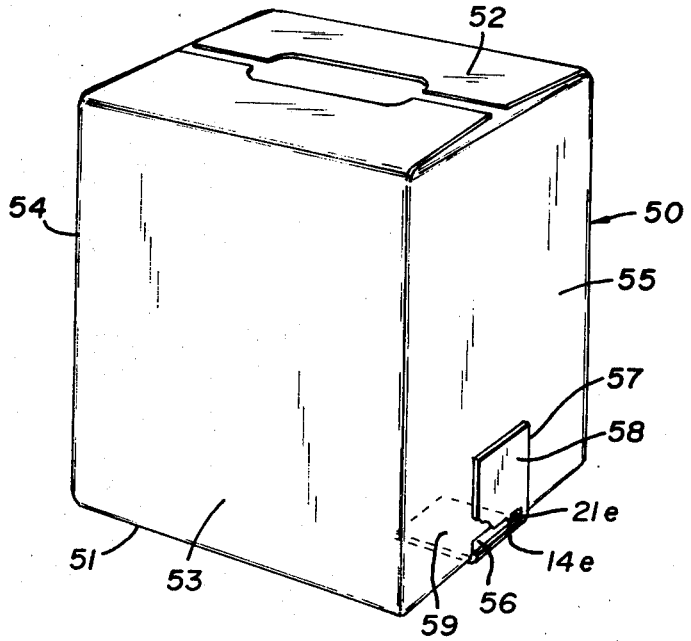
FIG. 7 is a perspective view of another apparatus embodying the invention.

In FIG. 7, a box 50, constructed from corrugated cardboard or other suitable material, is defined by a bottom wall 51, a top wall 52, a pair of side walls 53 and two end walls 54 and 55. Either or both of the bottom wall 51 and the top wall 52 may serve as a closure for the box 50. An elongated opening in end wall 54 adjacent to and immediately above the bottom wall 51 functions as a tape entrance slot 20*e* (not shown). As illustrated, the tape outlet 56 of box 50 does not have tabs along its upper edge. Such tabs could easily be formed while cutting out the opening but it is preferred to provide the tab means by mounting a bracket 57 on end wall 55 and bottom wall 51. Legs 58 and 59 of bracket 57 may be secured adhesively to said end wall and bottom wall, respectively, or by any other suitable means. Tape exit slot 21*e* in leg 58 is aligned with outlet 56 so that tabs 14*e* project downwardly on either side of the mid-point of the upper edge of said outlet.

Alternatively, bracket 57 may be supplanted by a clip inserted into outlet 56 so that two upright arms of the clip grasp the inner and outer faces of end wall 55 and a lip connecting the two arms bridges the upper edge of outlet 56. One or more tabs may protrude from the lip on each side of the mid-point of its edge in a direction opposite to that of the arms. A clip made from a resilient material such as spring steel will be retained in said outlet by the spring tension of the arms.

Figure 8:
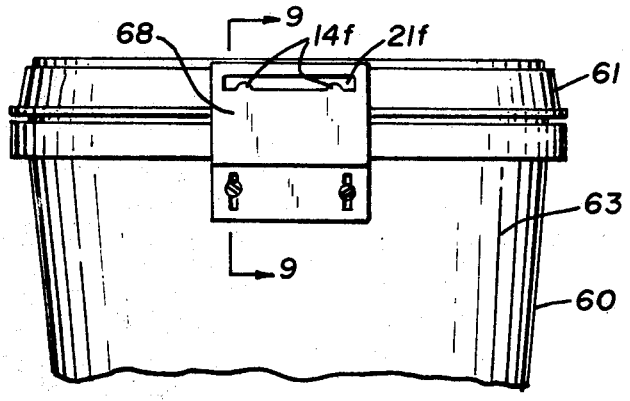
FIG. 8 is a front elevational view of another apparatus embodying the invention.
Figure 9:
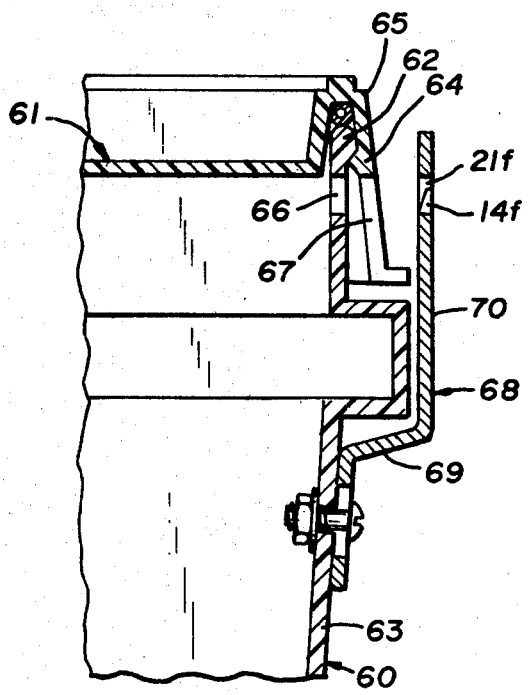
FIG. 9 is a partial cross section of the apparatus of FIG. 8 along line 9—9 of FIG. 8.

Turning now to FIGS. 8 and 9, pail 60 and lid 61 are mated by the frictional engagement of edge 62 of wall 63 with ridge 64 on the inner face of skirt 65. A tape exit slot 66 is formed in wall 63 adjacent to edge 62 and a similar slot (not shown) at the diametrically opposed position in wall 63 serves as the tape entrance slot. A notch 67 and its opposite counterpart (not shown) in skirt 65, having a shape similar to that of notches 19 in FIGS. 1 and 2, permit the passage of a joint tape through the pail 60 and the lid 61 and past tab means 68 which is attached to wall 63 by any suitable means such as that shown or an adhesive. Tab means 68 is a flange having an outwardly projecting segment 69 and and an upwardly projecting segment 70 in which slot 21*f* is cut. One or more tabs 14*f* protrude on each side of the mid-point of the lower edge of slot 21*f*.

Figure 10:
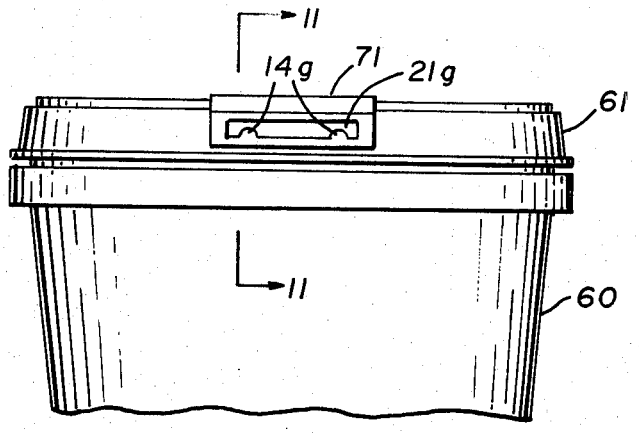
FIG. 10 is a front elevational view of another embodiment of the invention.
Figure 11:
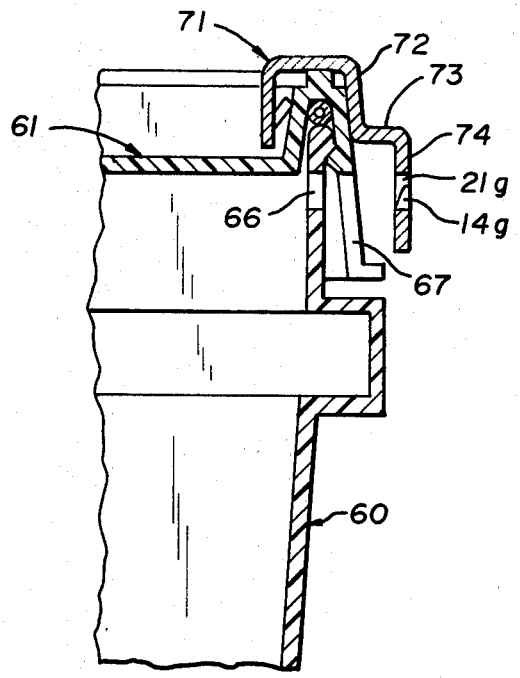
FIG. 11 is a partial cross section of the apparatus of FIG. 10 along line 11—11 of FIG. 10.

In FIGS. 10 and 11, tab means 71 has a bracket portion 72 by which it is attached to lid 61, an outwardly projecting flange portion 73, and a downwardly projecting flange portion 74 in which slot 21*g* is formed to be in alignment with tape exit slot 66 and notch 67. Tabs 14*g*, protruding from the lower margin of slot 21*g*, are adapted to urge a joint compound loaded tape away from said margin when the apparatus is in use.

The apparatus of this invention is used to dispense joint compound and apply it to seam tape by placing the compound into, for example, pail 10, drawing a length of tape from a roll thereof (not shown) and laying it across both notches 13, placing lid 16 on the pail so that notches 19 are superimposed over notches 13 to form slots 20*a* and 21*a*. The mated pail and lid are inverted and the tape is pulled through the slots causing it to glide over the inner face of the lid along a path between the slots and gather joint compound pressing down upon it. The pail and lid combination may be placed on the floor next to the workman's feet and the tape may be drawn out of the exit slot at any angle between 0° and about 75° or even closer to vertical. Said tabs urge the tape away from said margin, thereby allowing an evenly distributed layer of joint compound to adhere to the tape over the full width thereof except for the path formed by the scraping action of the tabs. The thickness of the layer, commonly about 0.05 to 0.10 inch, depends solely on the gap of the exit slot 21*a*.

Numerous modifications of the invention may occur to those skilled in the art, thus, the invention is not limited by the foregoing illustration and description of various embodiments of it.

What is claimed is:

1. Apparatus for applying joint compound on wall board seam tape consisting essentially of a pail adapted to receive said joint compound and having a side wall whose upper edge includes a pair of opposed elongate notches, and a lid having a top wall and a skirt pendent therefrom along its perimeter and whose lower edge includes a pair of opposed elongate notches which are superimposable over said side wall notches to form a tape entrance slot and a tape exit slot, the lower horizontal margin of the side wall notches including one blunt-edged tab protruding on each side of centerline thereof and approaching the upper edge of the side wall, whereby the notches may be aligned to form slots and the container inverted to place the container in a dispensing mode such that a tape being drawn through the slots is contacted only by the tab portions of the side wall notches.

2. Apparatus for applying joint compound on wall board seam tape consisting essentially of:

a. a container adapted to receive a supply of said compound and having a bottom wall and a side wall and;

b. a lid having a top wall and a skirt pendent from said wall along the perimeter thereof, said skirt having a ridge along its inner face adapted to rest upon the upper edge of the container side wall, said skirt having a tape entrance alot and a tape exit slot having one blunt-edged tab protruding from the lower margin thereof on each side of the mid-point of the edge of said slot and approaching the upper margin thereof;

whereby the apparatus may be placed in the dispensing mode by placing the lid on the container so that said ridge engages the upper edge of the container sidewall and inverting the apparatus, thereby reversing the positions of the lower and upper margin of the exit slot in relation to the ground, so that said tab urges a tape being drawn through said slots away from the upper margin of the inverted slots.

3. The apparatus of claim 2 wherein the lower face of the lid's top wall is tapered inwardly and upwardly from a plane above the shoulder of the lid to a plane immediately above the upper margin of the exit.

4. Apparatus for dispensing joint compound from a container onto wall board seam tape consisting essentially of a lid having a top wall and a skirt pendent from said wall along the perimeter thereof, said skirt having a ridge along its inner face adapted to rest upon the upper edge of the container, said skirt having a tape entrance slot and a tape exit slot overlying the upper border of said ridge, said tape exit slot having one blunt-edged tab protruding from the lower margin thereof on each side of the mid-point of the edge of said slot and approaching the upper margin thereof; whereby, upon insertion of such a tape through both slots, placement of the lid on such a container of joint compound, inversion of the mated container and lid, and drawing of such tape through the slotted lid, said joint compound is dispensed onto the tape as the tape is being urged away from the upper margin of the inverted exit slot by said tabs.

* * * * *